US005848755A

United States Patent [19]

Zickell et al.

[11] Patent Number: 5,848,755

[45] Date of Patent: Dec. 15, 1998

[54] ASPHALT MATERIAL RECYCLING SYSTEM AND METHOD

[75] Inventors: Thomas J. Zickell, Stratham; Mat Bockh, Gilford, both of N.H.; Charles Diman, Billerica, Mass.

[73] Assignee: Environmental Reprocessing Inc., Brentwood, N.H.

[21] Appl. No.: 756,881

[22] Filed: Dec. 2, 1996

[51] Int. Cl.[6] ..... B02C 19/12

[52] U.S. Cl. ..... 241/65; 241/171; 241/183

[58] Field of Search ..... 241/23, 31, 65, 241/66, 67, 80, 97, 177, 183, 171, DIG. 38, 54, 19

[56] References Cited

U.S. PATENT DOCUMENTS

| | | | |
|---|---|---|---|
| 1,934,930 | 11/1933 | Kent | 241/54 |
| 2,098,054 | 11/1937 | McBerty | 241/171 |
| 2,602,594 | 7/1952 | Hesse | 241/19 |
| 4,009,992 | 3/1977 | Eicke . | |
| 4,300,292 | 11/1981 | Vadas et al. . | |
| 4,477,250 | 10/1984 | Brashears et al. | 241/23 |
| 4,504,149 | 3/1985 | Mendehall . | |
| 4,706,893 | 11/1987 | Brock . | |
| 5,098,025 | 3/1992 | Drouin et al. | 241/23 |
| 5,188,299 | 2/1993 | Hendrickson et al. | 241/23 |
| 5,219,450 | 6/1993 | Thurk . | |
| 5,229,095 | 7/1993 | Schimmel et al. . | |
| 5,294,061 | 3/1994 | van Dijk . | |
| 5,385,426 | 1/1995 | Omann . | |

*Primary Examiner*—Mark Rosenbaum
*Attorney, Agent, or Firm*—Bourque & Associates P.A.

[57] ABSTRACT

An asphalt roofing material recycling system and method is used to recycle asphalt materials, such as asphalt shingles and tar paper that include granules, fibers or other particles. The asphalt material is simultaneously heated and milled in a heated milling apparatus, such as a heated ball mill, to reduce the asphalt material granules to a fine mesh in suspension in liquid asphalt. Excess moisture is removed from the asphalt material being recycled, either during heating and milling by continuously venting the heated milling apparatus, or before the heating and milling in a drying apparatus. The heated milling apparatus preferably includes a rotatable milling vessel rotated at an acute angle with respect to the horizontal plane and having an opening that provides continuous venting. The rotatable milling vessel includes a plurality of mixing members, such as rods or paddles, extending from an interior surface and preferably arranged in a helical pattern to force the asphalt material away from the opening. The asphalt material recycling system further includes a storage apparatus for storing reduced asphalt material and a filter apparatus for filtering reduced asphalt and removing foreign objects therefrom.

12 Claims, 7 Drawing Sheets

ASPHALT MATERIAL RECYCLING SYSTEM AND METHOD

FIELD OF THE INVENTION

This invention relates to a recycling system and method and in particular, to a system and method of recycling granular and non-granular coated asphalt material.

BACKGROUND OF THE INVENTION

Considerable waste is involved with the manufacture and use of asphalt roofing materials, such as shingles and roll roofing membranes. For example, each new shingle has cutout tabs that are removed and discarded. Old shingle materials removed from old buildings also add to a significant amount of roofing material waste.

Waste generated from roofing materials such as asphalt shingles presents a significant environmental concern because of the composition of the roofing material. Typical shingles are composed of a cellulose fiber or fiberglass mat, an asphalt coating on the mat, and granules disposed on the coating. Such materials are difficult to break down and have typically required complex recycling processes.

Past attempts at recycling asphalt shingles have also failed to reduce the shingle granules to a size small enough for the recycled shingle material to be reused. If the granules in the recycled shingle material are not reduced to a fine granulation, the granules will not remain suspended in an asphalt solution and the recycled shingle material cannot be reused in roofing or other products.

Some past methods of recycling asphalt roofing material have used milling machines, such as rolling mills, bag mills, hammer mills, saw mills, etc. to produce a recycled roofing material which can be used only in road construction or as other similar "filler" material. However, merely milling the shingle material in a reduction mill without further processing has been unsuccessful in reducing the granules in the shingle material to a fine mesh so that the recycled asphalt can be reused in roofing products.

One such apparatus for recycling roofing shingles is disclosed in U.S. Pat. No. 4,706,893 to Brock. This apparatus includes a hammer mill that comminutes the shingles and a vessel that subsequently dries then mixes the recycled shingle material with a liquid asphalt, for recycling as an asphalt paving composition. This milling process will not reduce the granules in the shingle material to a small enough size for the shingle material to be reused in applications other than an asphalt paving composition.

Another shingle reducing apparatus is disclosed in U.S. Pat. No. 5,385,426 to Omann. This complex apparatus includes a shredder, two hammer mills, and two heated vessels for drying the shingle material after it has been reduced. This apparatus further requires spraying the shingles with water prior to entering the first hammer mill. This extremely complex and involved process requiring two hammer mills also is not capable of completely reducing the granules in the recycled shingle material to a fine mesh or powder.

One reason milling machines have been unsuccessful in reducing the granules in the recycled shingle material is because the shingle material was not heated as it was milled. In the past, heating the milling machine as the shingle material is milled was considered hazardous because of pressure build up in the closed milling vessel or heating vessel as a result of moisture in the shingle material. Heating would also make hammer mills gum up and not work because the asphalt would become sticky.

SUMMARY OF THE INVENTION

Accordingly, the present invention provides an asphalt material recycling apparatus and method that is capable of recycling asphalt shingle material and reducing granules, cellulose fibers, fiberglass fibers and other particles in the asphalt shingle material to a fine mesh that can be maintained in suspension in liquid asphalt for later reuse. Such an apparatus and method for recycling asphalt roofing materials is capable of simultaneously milling and heating the asphalt shingle material without any danger of pressure build up. Simultaneously heating and milling is also more economical because the BTU's from the milling process are captured and used in the processing of the recycled product into a roofing product since the temperature of the recycled product is close to the required processing temperature. The apparatus and method is also relatively simple so as to maximize production and efficiency and to avoid clogging of the recycled shingled material during the recycling process.

The present invention features an asphalt material recycling system and method for recycling asphalt material, such as granular asphalt roofing material. The method comprises removing excess moisture from the asphalt material, and simultaneously heating and milling the asphalt material in a heated milling apparatus, for reducing the asphalt material.

According to one method, the step of removing moisture is performed simultaneously with the heating and milling of the asphalt material, by continuously venting the heated milling apparatus during heating and milling. The heating and milling in the heated milling apparatus preferably includes rotating a milling vessel containing a plurality of milling elements and the asphalt material at an acute angle with respect to the horizontal plane, and heating the milling vessel with a heat source while rotating the milling vessel. The milling vessel is preferably continuously vented through an opening in the milling vessel while rotating and heating to remove moisture from the asphalt material during heating and milling of the asphalt material. The method further includes inserting asphalt material into an opening of the milling vessel to an interior milling region, and forcing the asphalt material in the interior region away from the opening in the milling vessel. The roofing material is preferably fed into the milling vessel while it is rotating, speeding up the recycle time significantly.

Another method of recycling asphalt material further includes drying the asphalt material in a drying apparatus, for removing moisture from the asphalt material, prior to heating and milling the asphalt material. This method further includes the step of transferring the dried asphalt material to the heated milling apparatus.

The recycling method further includes storing the reduced asphalt material in a storage apparatus. Storing the reduced asphalt material preferably includes rotating the reduced asphalt material in a storage drum at an acute angle with respect to the horizontal plane, and heating the storage drum.

The recycling method further includes filtering the reduced asphalt material, for removing foreign objects in the reduced asphalt material. Filtering reduced asphalt material preferably includes passing the reduced asphalt material through a heated filtering apparatus and preventing foreign objects from passing through the heated filtering apparatus.

The asphalt material recycling system of the present invention includes a heated milling apparatus including a rotatable milling vessel having an opening and an interior milling region for receiving the asphalt material. A milling vessel rotation mechanism is coupled to the milling vessel for rotating the milling vessel and asphalt material in the interior milling region. A plurality of milling elements are disposed within the rotatable milling vessel for milling the asphalt material as the rotatable milling vessel rotates. A milling vessel heat source is disposed proximate the rotatable milling vessel, for heating the rotatable milling vessel as the milling vessel rotates and the asphalt material is milled. The axis of rotation of the milling vessel is preferably disposed at an acute angle with respect to the horizontal plane such that the milling vessel is rotated at the acute angle.

The heated milling apparatus preferably includes a plurality of mixing members mounted to an interior surface of the rotatable milling vessel, for moving and mixing the asphalt material with the milling elements. The mixing members are preferably mounted in a substantially helical pattern on the interior surface of the rotatable milling vessel, for moving the asphalt material away from the opening of the rotatable milling vessel during rotation. The mixing members preferably include rods mounted to the interior surface of the rotatable milling vessel and extending into the interior milling region.

The filtering apparatus preferably includes a filter housing having an inlet, for receiving reduced asphalt material, and an outlet, for discharging filtered, reduced asphalt material. One or more filter cartridges are disposed in the filter housing. Each filter cartridge has a plurality of apertures, for allowing reduced asphalt to pass through and for preventing foreign objects from passing through the filter cartridge. The filter apparatus further includes a filter heat source, for heating the filter housing and the reduced asphalt material during filtering.

The storage apparatus preferably includes a rotatable storage drum having an opening and an interior storage region, for receiving reduced asphalt material. A storage drum rotation mechanism is coupled to the rotatable storage drum, for rotating the rotatable storage drum and the reduce asphalt in the interior storage region. A storage heat source is disposed proximate the rotatable storage drum, for heating the rotatable storage drum while rotating and storing the reduced asphalt material. The storage apparatus further includes a plurality of mixing members such as fins mounted to an interior surface of the rotatable storage drum in a substantially helical pattern allowing asphalt to be mixed when the drum is rotated in one direction and allowing the material to be conveyed out of the opening when rotated in the other direction without pumping the material.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
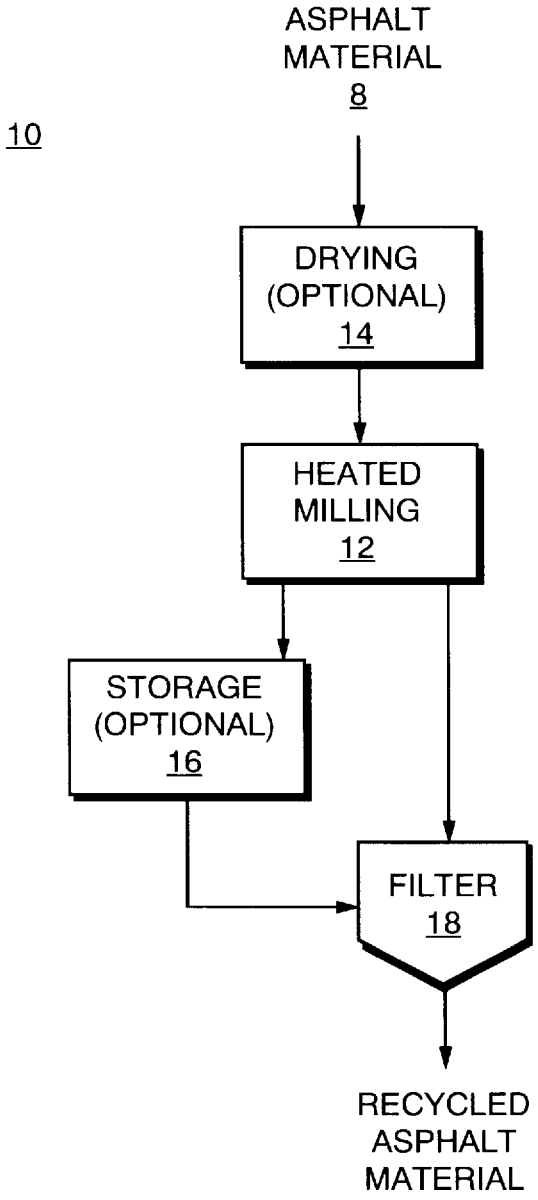
FIG. 1 is a schematic block diagram of an asphalt material recycling system and method according to the present invention.

An asphalt material recycling system and method 10, FIG. 1, according to the present invention is used to recycle asphalt material, such as asphalt (organic and fiberglass based) roof shingles, tar paper, roll roofing, built up roofing and other similar granular or non-granular asphalt coated materials. The granules, fibers or other particles are reduced to a fine mesh forming a liquefied paste with the asphalt that can be stored and/or reused in asphalt roofing products, asphalt paving compositions, and other applications. Although the recycling system and method is described as an asphalt material recycling system and method, the present invention contemplates using the same system and method to recycle other types of granular impregnated or granular coated asphaltic compositions, such as asphalt paving and asphalt built up roofing.

According to the asphalt material recycling method of the present invention, excess moisture and other built up gases are removed from the asphalt material, and the asphalt material is simultaneously heated and milled. The asphalt material is preferably heated to a temperature in the range of about 300° to 450° F. and most preferably about 350° F. The simultaneous heating and milling is preferably performed until the granules or particles in the asphalt material is reduced or formed into smaller sized particles, preferably a fine mesh having a granular size of approximately 1/32 of an inch or less. By varying the heating and milling of the asphalt material, the asphalt material can be reduced to any desired granule size.

The reduced granules or particles form a liquefied paste together with the asphalt. During the milling process, additional virgin asphalt in liquid form can be added to the heated milling apparatus to further liquefy the asphalt material (e.g. scrap shingles or roofing manufacturing waste) being recycled to maintain a liquefied consistency allowing the reduced asphalt material to be poured or pumped from the heated milling apparatus 12.

The removal of excess moisture or gases from asphalt material, either prior to heating and milling or during heating and milling, allows for the simultaneous heating and milling of the asphalt material without a dangerous pressure build up and possible explosion in the heated milling apparatus 12 and avoids having to use expensive pressure vessels. According to one embodiment, the moisture is removed from the asphalt material simultaneously with the heating and milling of the asphalt material, by continuously venting the heated milling apparatus 12, as will be described in greater detail below. According to another embodiment, the asphalt material may be first dried in a drying apparatus 14, such as a rotary kiln. The drying apparatus 14 removes a significant amount of the moisture or gases from the asphalt material prior to heating and milling of the asphalt material in the heated milling apparatus 12, as will be described in greater detail below.

One embodiment of the asphalt material recycling system 10 also includes a storage apparatus 16 that receives and stores reduced asphalt material from the heated milling apparatus 12. The storage apparatus 16 preferably mixes and heats the reduced asphalt material during storage, as will be described in greater detail below.

One embodiment of the asphalt material recycling system 10 includes a filter apparatus 18 that receives reduced asphalt material from either a storage apparatus 16 or directly from the heated milling apparatus 12. The filter apparatus 18 filters the reduced asphalt material to remove foreign objects, such as nails, metal scraps, or other debris that has not been reduced to a smaller size particle. The filter apparatus 18 allows the reduced asphalt material to pass through while preventing foreign objects such as sticks, wood, stones and other large particulates from passing through, as will be described in greater detail below.

Figure 2A:
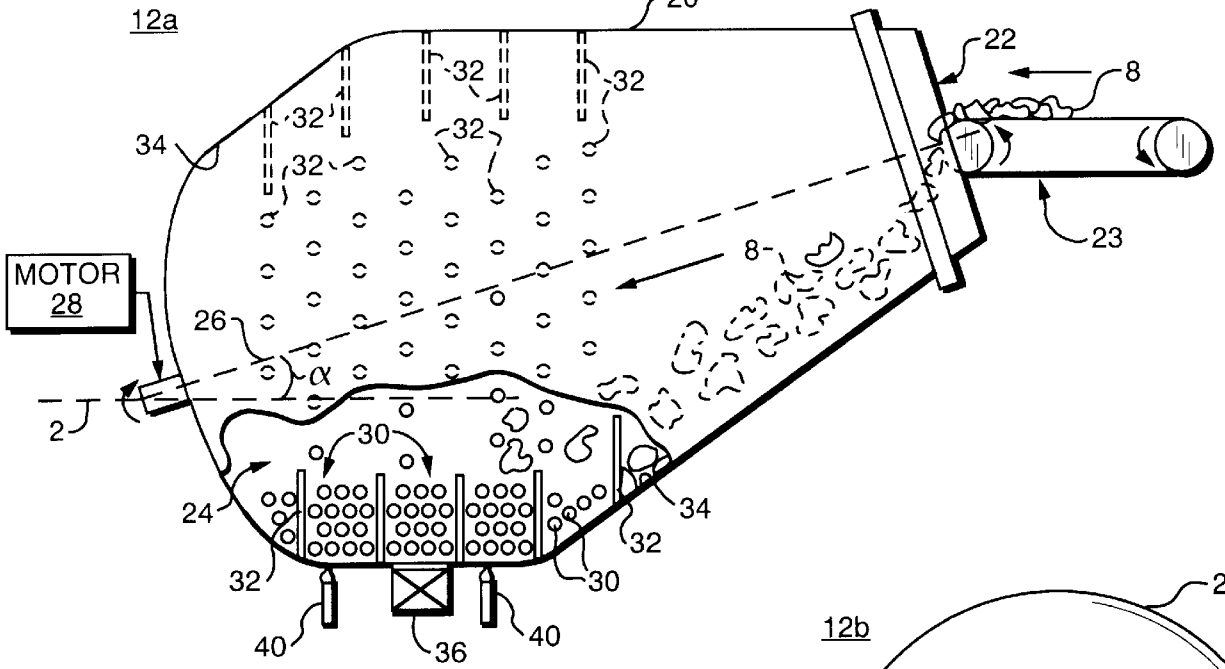
FIGS. 2A and 2B are side, partial cross-sectional views of a heated milling apparatus according to various embodiments of the present invention.

One embodiment of the heated milling apparatus 12*a*, FIG. 2A, includes a rotatable milling vessel 20 having at least one opening 22 and an internal milling region 24 that receive asphalt material 8 to be recycled. The opening 22 is preferably left open to continuously vent the interior milling region 24 of the rotatable milling vessel 20, allowing moisture to be removed while heating and milling the asphalt material 8. The opening 22 is also preferably large enough to allow a conveyor 23 or other similar device to convey or deliver the asphalt material 8 to be recycled through the opening 22 and into the internal milling region 24.

The milling vessel 20 preferably has an axis of rotation 26 disposed at an acute angle $\alpha$ with respect to the horizontal plane 2. The acute angle $\alpha$ is preferably in the range of 5° to 45°. The rotatable milling vessel 20 is rotated at the acute angle $\alpha$ with respect to the horizontal plane 2 with a rotation mechanism 28, such as a motor and gear mechanism coupled to the rotatable milling vessel 20. The opening 22 of the rotatable milling vessel 20 is thereby elevated with respect to the rotatable milling vessel 20 so that asphalt material moves from the opening 22 towards the interior milling region 24, allowing the opening 22 to continuously vent the milling vessel 20.

The heated milling apparatus 12*a* further includes a plurality of milling elements 30, such as balls or rods made of steel or another suitable metal or non-metal, disposed in the interior milling region 24. As the rotatable milling vessel 20 rotates, the milling elements 30 move throughout the rotatable milling vessel 20, grinding, crushing and abrading the asphalt material 8 to reduce the size of the asphalt material. One example of the milling elements 30 includes steel balls ranging in size from 1 to 1½ inches and filling approximately ⅓ to ½ of the rotatable milling vessel 20. The present invention contemplates other types of milling elements of various sizes and materials.

One embodiment of the rotatable milling vessel 20 further includes a plurality of mixing members 32 mounted on an interior surface 34 of the rotatable milling vessel 20, such as rods or "paddles" welded to the interior surface 34 and extending into the interior milling region 24. The mixing members 32 are preferably arranged in a helical pattern on the interior surface 34 of the rotatable milling vessel 20 to force the asphalt material 8 away from the opening 22 and towards the interior milling region 24 and milling elements 30 when the rotatable milling vessel 20 rotates.

On example of the milling vessel 20 has a volume of about 10 cubic yards and rotates at a speed of about 20 Rpm's allowing milling and filling of the vessel 20 to occur simultaneously. The rotatable milling vessel 20 also preferably includes an outlet or discharge area valve 36 that allows the reduced asphalt material to be discharged from the rotatable milling vessel 20.

The heated milling apparatus 12*a* further includes one or more heat sources 40, such as an external flame, disposed proximate the rotatable milling vessel 20 to provide heat to the rotatable milling vessel 20. The present invention also contemplates other types of heat sources, such as hot oil, as will be described in greater detail below.

Figure 2B:
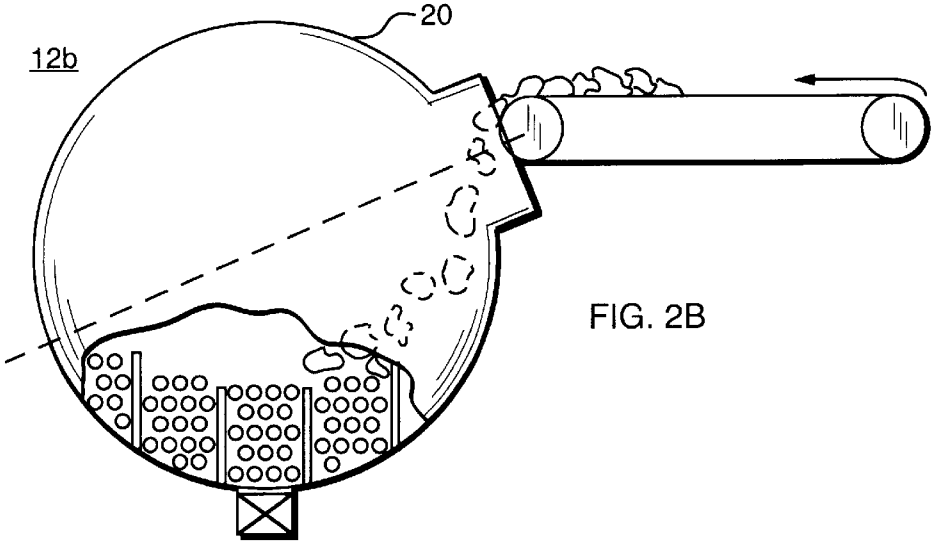

An alternative embodiment of the heated milling apparatus 12*b*, FIG. 2B, includes a rotatable milling vessel 20*b* having a round or spherical shape. The present invention contemplates heated milling vessels 20 of any desired shape.

Figure 3:
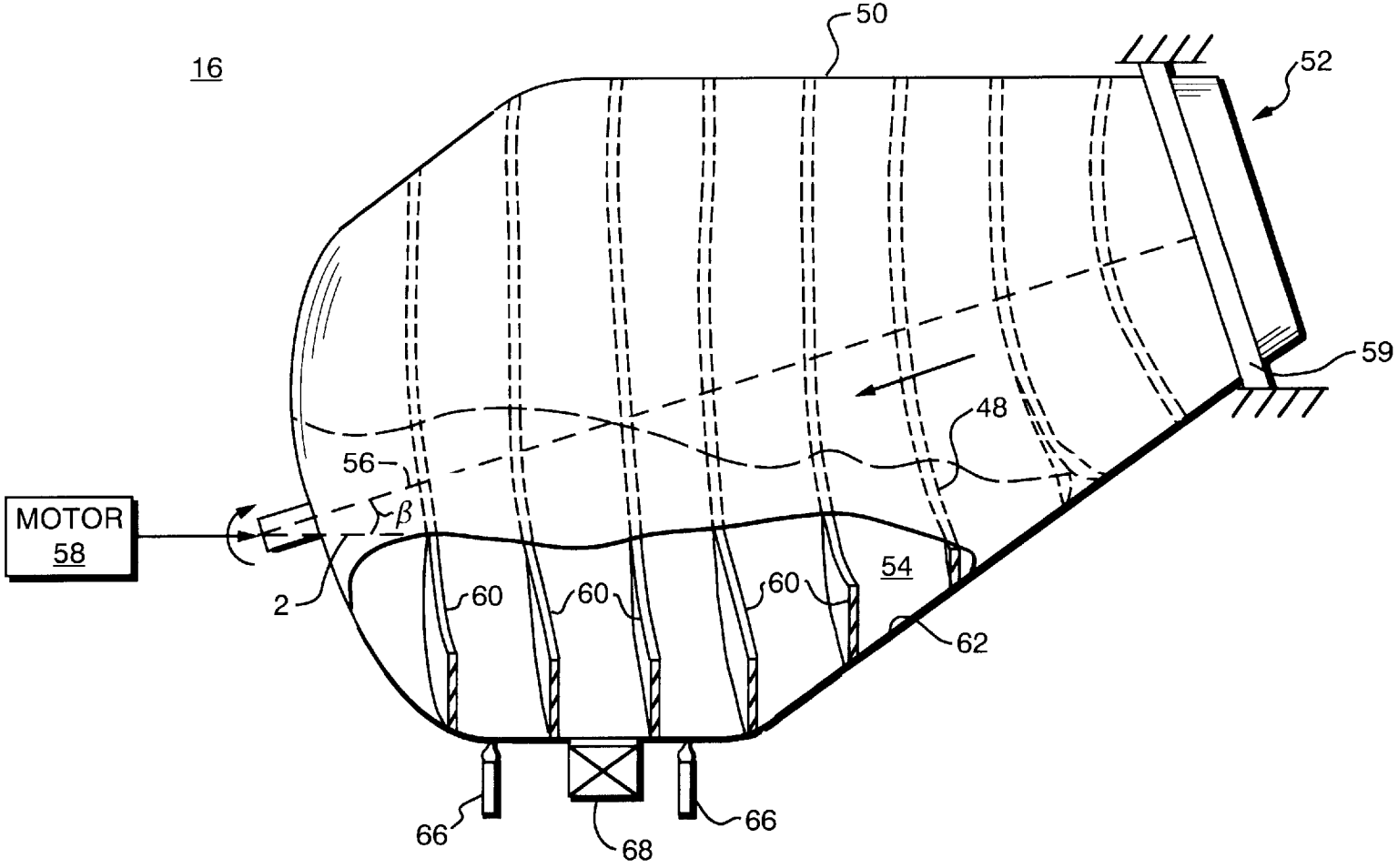
FIG. 3 is a side view with partial cut-out of a storage apparatus used with the asphalt recycling system and method according to one embodiment of the present invention.

The preferred embodiment of the storage apparatus 16, FIG. 3, includes a rotatable storage vessel 50 similar to the rotatable milling vessel 12*a* described above. The rotatable storage vessel 50 includes an opening 52 and interior storage region 54 that receives the reduced asphalt material from the heated milling apparatus 12. The reduced asphalt material is transferred from the milling apparatus 12 to the storage apparatus 16, for example, by pumping the material or gravity feeding the material by elevating the milling apparatus 12 with respect to the storage apparatus 16. The opening 52 preferably remains open to provide continuous venting of the interior storage region 54. Alternatively, a pressure vessel can be used as storage vessel 50.

The rotatable storage vessel 50 also preferably has an axis of rotation 56 disposed at an acute angle $\beta$ with respect to the horizontal plane 2. The acute angle $\beta$ is preferably in the range of 5° to 45°. The rotatable storage vessel 50 is thus rotated about the axis of rotation 56 at the acute angle $\beta$ allowing the opening 52 to be elevated with respect to the internal storage region 54 of the rotatable storage vessel 50. Rotation is preferably accomplished with a rotation mechanism 58, such as a motor and gear mechanism, coupled to the rotatable storage vessel 50. The rotatable storage vessel 16 can also include one or more bearings 59 spaced along the rotatable storage vessel 50 to support the rotatable storage vessel 50 during rotation.

The rotatable storage vessel 50 preferably includes one or more mixing members 60, such as fins or "paddles", for mixing the reduced asphalt material 48 while the rotatable storage vessel 50 is rotated. The mixing members 60 are preferably mounted in a helical arrangement on the interior surface 62 of the rotatable storage vessel 50. The helical arrangement of the mixing members 60 forces the reduced asphalt material 48 away from the opening 52 during rotation of the storage vessel 50. To dispense the reduced asphalt material 48, rotation of the rotatable storage vessel 50 is reversed and the mixing members 60 arranged helically on the inner surface 62 of the rotatable storage vessel 50 will force the reduced asphalt material 48 toward the opening 52.

The storage apparatus 16 also includes one or more heat sources 66, such as an external flame or hot oil circulating around the rotatable storage vessel 50 in a jacket. Heating of the rotatable storage vessel 50 during storage facilitates mixing of the reduced asphalt material and maintains the desired consistency of the reduced asphalt material for later use, for example, to be applied as a coating in a production process. The storage apparatus 16 can also include an outlet or discharge valve 68 that allows the reduced asphalt material 48 to be discharged from the rotatable storage vessel 50.

Figure 4:
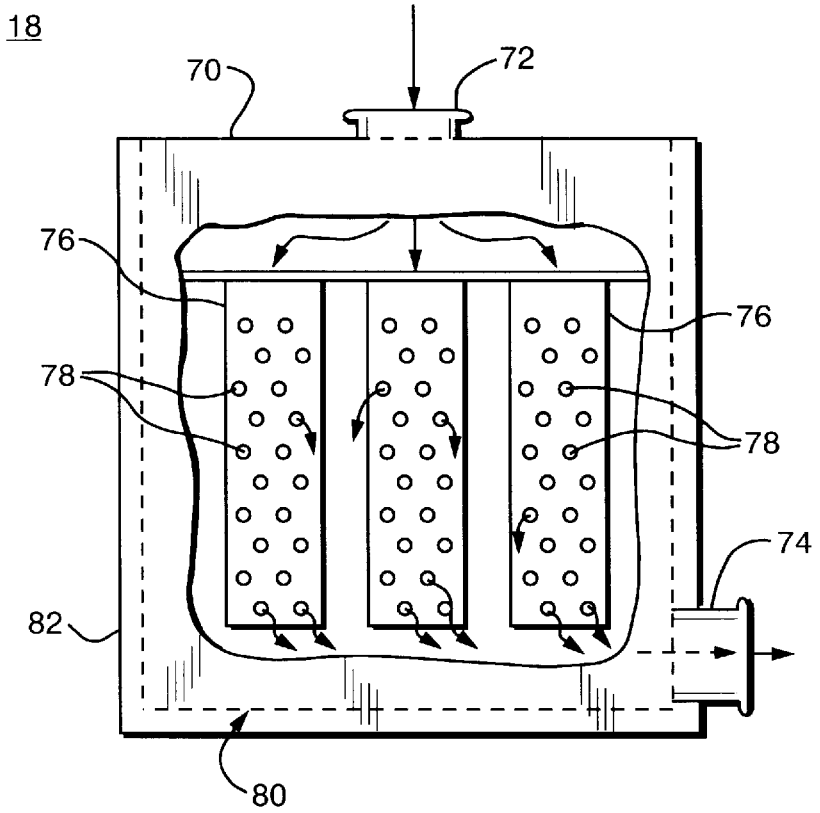
FIG. 4 is a side, partial cross-sectional view of a filtering apparatus used with the asphalt material recycling system and method according to one embodiment of the present invention.

The preferred embodiment of the filtering apparatus 18, FIG. 4, includes a filter housing 70 having an inlet 72, for receiving reduced asphalt material 48 from a storage apparatus or directly from a heated milling apparatus, and an outlet 74, for discharging filtered reduced asphalt material. The filter apparatus 18 includes one or more filter members or cartridges 76 disposed or mounted within the filter housing 70, for allowing reduced asphalt material to pass through while preventing larger material and foreign objects, such as nails, metal material, and other debris that has not been reduced, from passing through. The filter cartridges 76 include one or more apertures 78 that are dimensioned and sized, e.g., about 1/16 to 1/8 inches, to prevent the foreign objects or undesirable debris from passing through the filter cartridge 76. The perforations or apertures 78 can have various sizes or dimensions to provide various degrees of filtering from course filtering to fine filtering.

The filter apparatus 18 preferably includes a filter heat source 80, such as hot oil or other liquids, maintained in contact with the filter housing 70 by means of a jacket 82 surrounding the filter housing 70. The heating of the filter housing 70 maintains the desired consistency of the reduced asphalt material to facilitate the flow and filtering of the reduced asphalt material.

Figure 5:
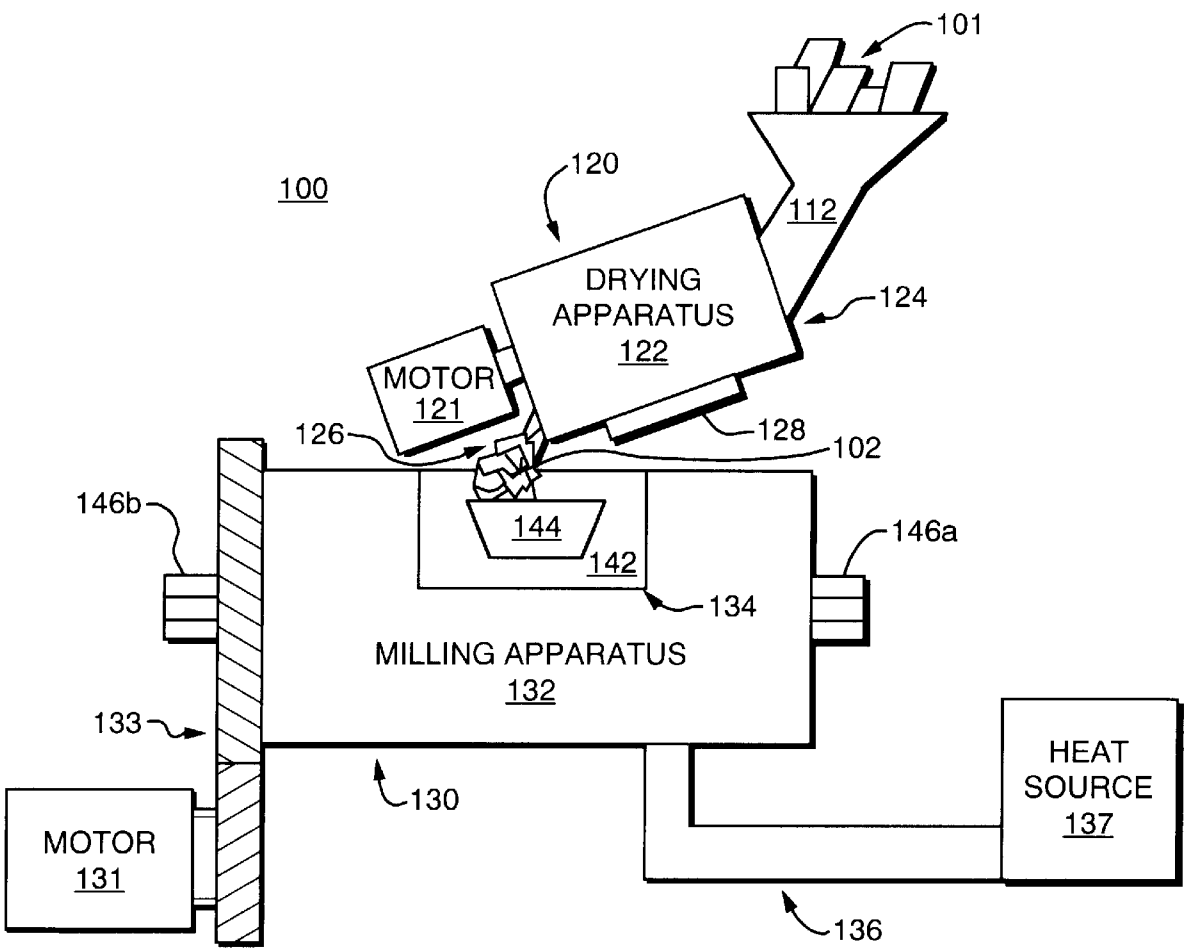
FIG. 5 is a schematic view of another embodiment of the asphalt material recycling system according to the present invention.

Another embodiment of an asphalt material recycling system 100, FIG. 5, includes a drying apparatus 120 together with a heated milling apparatus 130. The drying apparatus 120 removes the moisture from the asphalt material 110 prior to milling and heating the asphalt material in the heated milling apparatus 130. The drying apparatus 120 includes a rotatable drying vessel 122 similar to the storage vessel described above having an asphalt material receiving region 124 that receives the asphalt material 101, for example, discarded asphalt shingle tabs and old asphalt shingles. The rotatable drying vessel 122 further includes a dispensing region 126 that dispenses the pre-dried asphalt material 102 to the heated milling apparatus 130 after the moisture has been removed from the dried asphalt material 102 in the drying apparatus 120. Dispensing region 126 is preferably left open for moisture to escape.

The drying apparatus 120 further includes a motor 121 coupled to the rotatable drying vessel 122 and a rotatable drying vessel heat source 128, such as a flame, proximate the rotatable drying vessel 122. The heat source 128 heats the rotatable drying vessel 120 while the motor 121 rotates the rotatable drying vessel 122 to effectively dry or remove moisture from the asphalt roofing material 122 within the rotatable drying vessel 122. In the preferred embodiment, a hopper 112 or other similar feeding device is positioned proximate the receiving region 124 of the rotatable drying vessel 122, for feeding the asphalt material 101 to the rotatable drying vessel 122.

The drying apparatus 120 is preferably positioned above the heated milling apparatus 130 and in one example, at an angle of between 15° and 30° with respect to the heated milling apparatus 30, so that the dried asphalt material 102 can be easily transferred from the drying apparatus 120 to the heated milling apparatus 130.

The heated milling apparatus 130 includes a rotatable milling vessel 132 and a plurality of milling elements (not shown, but as previously described) contained within the rotatable milling vessel 132, for reducing the asphalt material. The rotatable milling vessel 132 includes a milling vessel receiving region 134, that receives pre-dried asphalt material 102 from the drying apparatus 120. The receiving region 134 can include a hatch 142 and a feeding device 144, such as a hopper, in communication with the rotatable milling vessel 132.

In a preferred embodiment, the milling apparatus 130 includes one or more ventilation devices **146*a*, 146*b*, such as vent pipes, located on the milling vessel 132, such as on one or more end regions of the milling vessel 132. One example of the ventilation devices 146*a*, 146*b* includes a piston or similar member slidably received in a vent aperture and actuated with a timing device. The ventilation devices 146*a*, 146*b* allow moisture or other trapped gases to escape from the milling vessel 132 during the heating and milling process. If the heated milling apparatus 130 is used without the drying apparatus 120, the ventilation devices 146*a*, 146*b* are a primary safety feature that prevents any dangerous build up of pressure in the milling vessel 132 when the asphalt material is heated and milled in the milling vessel 132. If the milling apparatus 130 is used with the drying apparatus 120, the ventilation devices 146*a*, 146*b* are secondary safety features that allow any remaining moisture (or other gases), not removed by the drying apparatus to escape from the milling vessel 132**.

The heated milling apparatus 130 further includes a milling vessel heat source 136 that provides heat to the rotatable milling vessel 132 and the asphalt material contained therein during the milling operation. In the preferred embodiment, the milling vessel heat source 136 includes a source 137 of hot oil or similar liquid maintained at a predetermined temperature and supplied to the outer region of the rotatable milling vessel 132, such as a jacket (not shown) positioned around the rotatable milling vessel 132, as will be described in greater detail below.

The milling apparatus 130 further includes a motor 131 coupled to the rotatable milling vessel 132, for rotating the rotatable milling vessel 132 and reducing the asphalt roofing material contained within the rotatable milling vessel 132. In one embodiment, motor 131 is a 10–50 HP motor coupled to the rotatable milling vessel 132 through a chain or gear mechanism 133 as is known to those skilled in the art.

Figure 6:
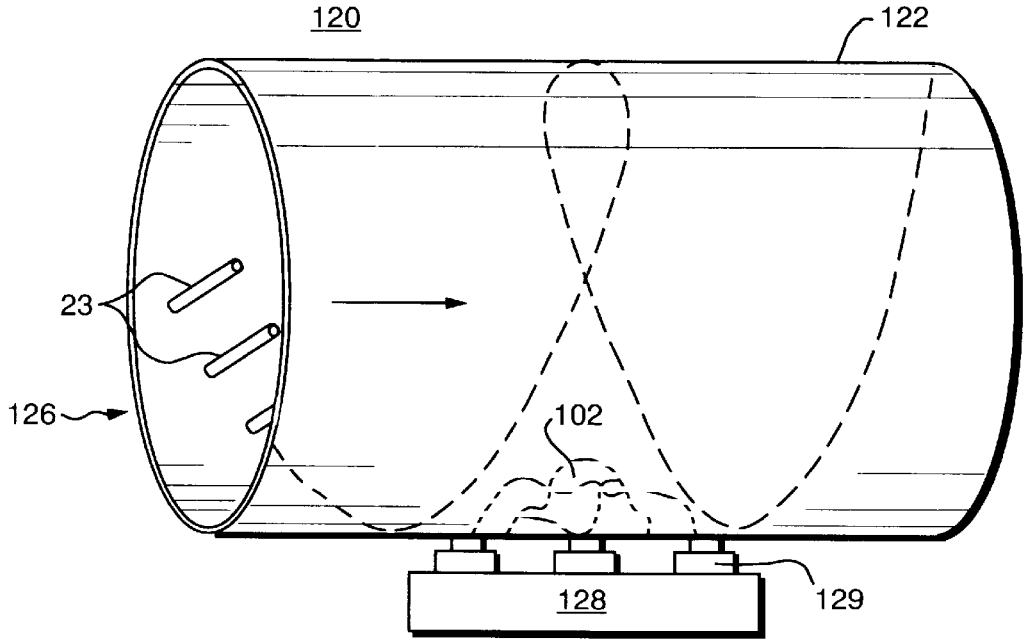
FIG. 6 is a perspective view of a drying apparatus according to one embodiment of the present invention.

In one embodiment, the drying apparatus 120, FIG. 6, is a rotary kiln. The rotatable drying vessel 122 of the rotary kiln 120 includes fins or baffles 123 extending from an inside surface of the rotatable drying vessel 122. The baffles 123 facilitate the drying operation by evenly distributing and tumbling the asphalt material 102 throughout the rotatable drying vessel 122 as the rotatable vessel 122 is rotated.

The baffles 123 are preferably arranged helically within the rotatable drying vessel 122 so that the asphalt roofing material 102 is evenly distributed throughout the rotatable drying vessel 122 when the rotatable drying vessel 122 is positioned at an angle. For example, the baffles 123 are helically arranged at a pitch counter to the angle of the drying vessel 122, allowing the asphalt material 102 to resist the force of gravity so that the material 102 does not move too quickly to the dispensing region 126 of the rotatable drying vessel 122.

The rotatable drying vessel heat source 128 providing heat to the rotary kiln 120 is preferably a gas heater having gas burners 129 providing heat to the rotary kiln 120. The gas burners 129 are positioned proximate the outer surface of the rotatable drying vessel 122 so that a flame from the gas burner 129 heats the rotatable drying vessel 122.

The rotatable drying vessel 122 of the drying apparatus or rotary kiln 120 is rotated, for example, at approximately 5 RPM to 10 RPM. The rotatable drying vessel 22 of the drying apparatus or rotary kiln 20 is preferably heated to a temperature of approximately 250°–400° F. to remove approximately 5% or more of the moisture in the asphalt material.

Figure 7:
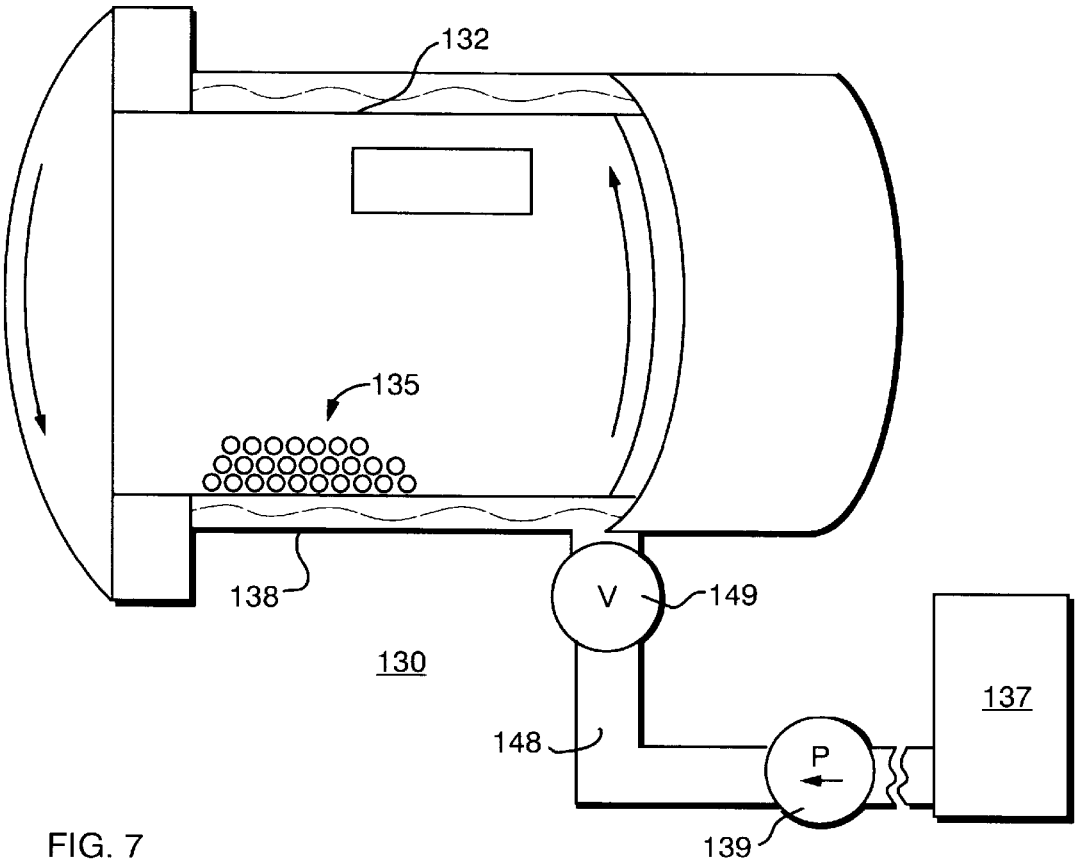
FIG. 7 is a perspective view of a heated milling apparatus according to another embodiment of the present invention.

In the preferred embodiment, the heated milling apparatus 130, FIG. 7, is a heated ball mill having a plurality of ball milling elements 135 within the rotatable milling vessel 132, similar to that described above. As the rotatable milling vessel 132 of the heated ball mill 130 rotates, the ball milling elements 135 move throughout the rotatable milling vessel 132 to reduce the granules or fibers in the asphalt material 102 into a fine mesh in suspension in the liquid asphalt.

In one embodiment, the heated milling apparatus 130 includes a jacket 138 positioned around the rotatable milling vessel 132 to allow hot oil or other heated fluid to circulate between the jacket 138 and the outer surface of the rotatable milling vessel 132. In one example, a pumping mechanism 139 pumps the hot oil from the source of hot oil 137 maintained at the predetermined temperature of approximately 250°–400° F. through a conduit 148, such as flexible piping, to a valve 149 coupled to the jacket 138. The hot oil supplied between the jacket 138 and the rotatable milling vessel 132 thereby heats the rotatable milling vessel 132 and the asphalt material 102 contained within the rotatable milling vessel during the milling operation.

Figure 8:
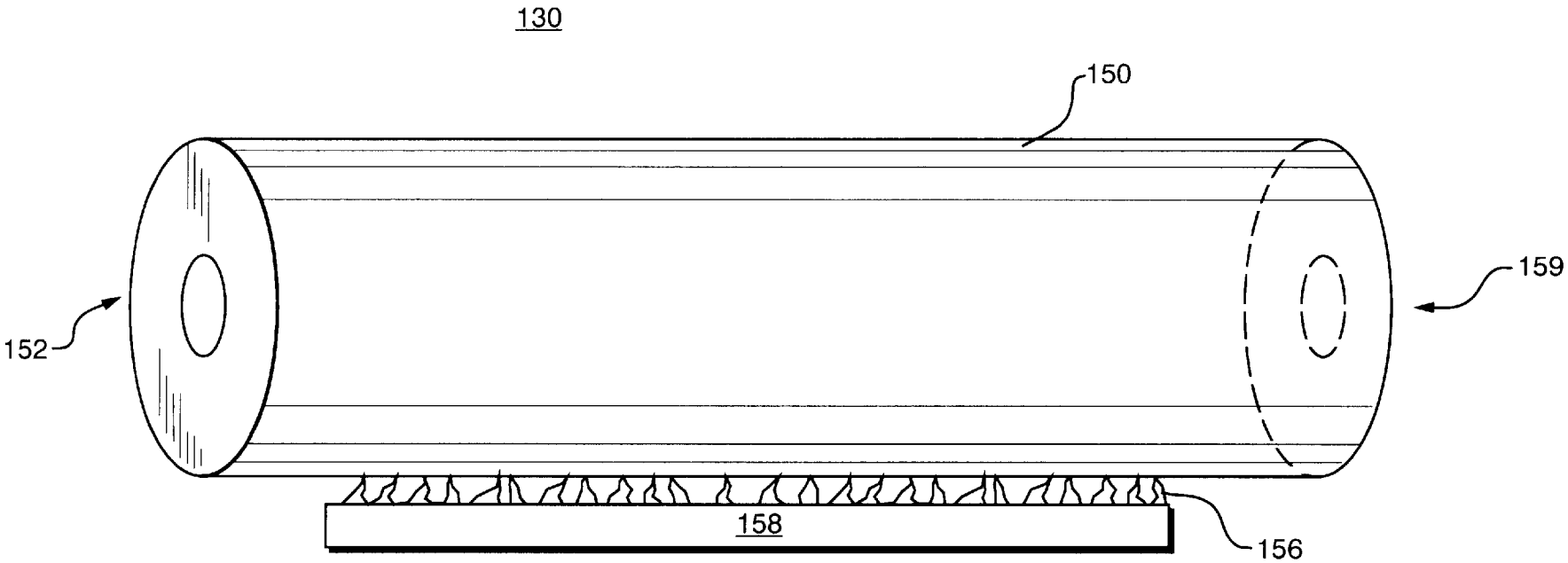
FIG. 8 is a side view of heated milling apparatus according to a further embodiment of the present invention.

In an alternative embodiment, the heated milling apparatus 130, FIG. 8, includes a continuous milling vessel 150 having a first open end 152 for feeding asphalt material into the milling vessel 150 and a second open end 154 acting as an exit for the heated and milled (recycled) asphalt material 102. In an alternative embodiment, the heated milling apparatus 130 can be heated with a direct external flame 156, such as from a gas burner 158, as described above with respect to the drying apparatus.

Accordingly, the combination of heating and milling the asphalt roofing material allows the asphalt roofing material including granules to be reduced to a fine mesh that is capable of being mixed in an asphalt solution and of being reused in asphalt roofing products, asphalt paving compositions, and other applications. The removal of moisture in the asphalt roofing material, such as by continuously venting the heated milling apparatus or with a drying apparatus, allows the asphalt roofing material to be simultaneously milled and heated in the heated milling apparatus without causing a dangerous pressure build up. The asphalt material recycling system and method of the present invention also provides a relatively simple and efficient way of recycling asphalt roofing materials and avoids the expense of complex asphalt recycling systems.

Modifications and substitutions by one of ordinary skill in the art are considered to be within the scope of the present invention which is not to be limited except by the claims which follow.

What is claimed is:

1. An asphalt material recycling system comprising:

a heated milling apparatus, for receiving asphalt material to be recycled and for simultaneously heating and milling said asphalt material until said asphalt material is reduced, said heated milling apparatus including:

a rotatable milling vessel having an opening to an interior milling region, for receiving the asphalt material to be recycled and for continuously venting said interior milling region and removing moisture from said asphalt material during heating and milling of said asphalt material, wherein an axis of rotation of said milling vessel is disposed at an acute angle with respect to a horizontal plane, and whereby said milling vessel is rotated at said acute angle with respect to said horizontal plane;

a milling vessel rotation mechanism, coupled to said rotatable milling vessel, for rotating said rotatable milling vessel and said asphalt material in said interior milling region;

a plurality of milling elements disposed within said rotatable milling vessel, for milling the asphalt material as said rotatable milling vessel rotates; and a milling vessel heat source, for heating said rotatable milling vessel as said rotatable milling vessel rotates and said asphalt material is milled; and a filtering apparatus, for receiving reduced asphalt material, and for filtering reduced asphalt material and removing at least foreign objects from said reduced asphalt material, said filtering apparatus including:

a filter housing having an inlet, for receiving said reduced asphalt material, and an outlet, for discharging filtered, reduced asphalt material; and at least one filter member disposed in said filter housing, said at least one filter member having a plurality of apertures, for allowing reduced asphalt to pass through sand filter member and for preventing at least foreign objects from passing through the filter member.

2. The asphalt recycling system of claim 1 wherein said heated milling apparatus includes a plurality of mixing members mounted proximate an interior surface of said rotatable milling vessel, for moving and mixing said asphalt material with said milling elements.

3. The asphalt recycling system of claim 2 wherein said plurality of mixing members are mounted in a substantially helical pattern on said interior surface of said rotatable milling vessel, for moving said asphalt material away from said opening of said rotatable milling vessel during rotation of said rotatable milling vessel.

4. The asphalt recycling system of claim 2 wherein said plurality of mixing members include a plurality of rods mounted proximate said interior surface of said rotatable milling vessel, said plurality of rods extending into said interior milling region of said rotatable milling vessel.

5. The asphalt recycling system of claim 1 further including a drying apparatus, for receiving said asphalt material to be recycled, and for drying and removing moisture from said asphalt material to be recycled and for providing at least partially dried asphalt material to be recycled to said heated milling apparatus.

6. The asphalt recycling system of claim of claim 5 wherein said drying apparatus includes a rotary kiln.

7. The asphalt recycling system of claim 1 wherein said filter apparatus further includes a filter heat source, for heating said filter housing and said reduced asphalt material during filtering.

8. The asphalt recycling system of claim 1 further including a storage apparatus, for storing reduced asphalt material.

9. The asphalt recycling system of claim 8 wherein said storage apparatus includes:

a rotatable storage vessel having an opening and an interior storage region, for receiving said reduced asphalt material;

a storage vessel rotation mechanism coupled to said rotatable storage vessel, for rotating said rotatable storage vessel and said reduced asphalt material in said interior storage region; and a storage heat source disposed proximate said rotatable storage vessel, for heating said rotatable storage vessel while rotating and storing said reduced asphalt material.

10. The asphalt recycling system of claim 9 wherein said storage apparatus further includes a plurality of mixing members mounted proximate an interior surface of said rotatable storage vessel in a substantially helical pattern, for mixing said reduced asphalt material when said rotatable storage vessel is rotated in a first direction and for dispensing said reduced asphalt material when said rotatable storage vessel is rotated in a second direction.

11. An asphalt material recycling system comprising:

a heated milling apparatus, for receiving asphalt material to be recycled and for simultaneously heating and milling said asphalt material until said asphalt material is reduced, said heated milling apparatus including:

a rotatable milling vessel having an opening to an interior milling region, for receiving the asphalt material to be recycled and for continuously venting said interior milling region and removing moisture from said asphalt material during heating and milling of said asphalt material, wherein an axis of rotation of said milling vessel is disposed at an acute angle with respect to a horizontal plane, and whereby said milling vessel is rotated at said acute angle with respect to said horizontal plane;

a plurality of mixing members mounted in a substantially helical pattern on said interior surface of said rotatable milling vessel, for moving said asphalt material away from said opening of said rotatable milling vessel during rotation of said rotatable milling vessel, and for mixing said asphalt material;

a milling vessel rotation mechanism, coupled to said rotatable milling vessel, for rotating said rotatable milling vessel and said asphalt material in said interior milling region;

a plurality of milling elements disposed within said rotatable milling vessel, for milling the asphalt material as said rotatable milling vessel rotates; and a milling vessel heat source, for heating said rotatable milling vessel as said rotatable milling vessel rotates and said asphalt material is milled.

12. An asphalt material recycling system comprising:

a heated milling apparatus, for receiving asphalt material to be recycled and for simultaneously heating and milling said asphalt material until said asphalt material is reduced, said heated milling apparatus including:

a rotatable milling vessel having an opening to an interior milling region, for receiving the asphalt material to be recycled and for continuously venting said interior milling region and removing moisture from said asphalt material during heating and milling of said asphalt material, wherein an axis of rotation of said milling vessel is disposed at an acute angle with respect to a horizontal plane, and whereby said milling vessel is rotated at said acute angle with respect to said horizontal plane;

a plurality of rods mounted proximate said interior surface of said rotatable milling vessel, said plurality of rods extending into said interior milling region of said rotatable milling vessel, for moving and mixing said asphalt material;

a milling vessel rotation mechanism, coupled to said rotatable milling vessel, for rotating said rotatable milling vessel and said asphalt material in said interior milling region;

a plurality of milling elements disposed within said rotatable milling vessel, for milling the asphalt material as said rotatable milling vessel rotates; and a milling vessel heat source, for heating said rotatable milling vessel as said rotatable milling vessel rotates and said asphalt material is milled.

* * * * *